US006006948A

United States Patent [19]

Auer

[11] Patent Number: 6,006,948

[45] Date of Patent: Dec. 28, 1999

[54] TWO-CHAMBER METERING DISPENSER

[75] Inventor: Günter Auer, Villingen-Schwenningen, Germany

[73] Assignee: Raimund Andris GmbH & Co. KG, Vilingen-Schwenningen, Germany

[21] Appl. No.: 09/134,723

[22] Filed: Aug. 14, 1998

[30] Foreign Application Priority Data

Nov. 17, 1997 [DE] Germany ..... 297 20 316 U

[51] Int. Cl.[6] ..... B67D 5/52

[52] U.S. Cl. ..... 222/137; 222/260

[58] Field of Search ..... 222/137, 260, 222/321.9, 383.1, 385, 321.8

[56] References Cited

U.S. PATENT DOCUMENTS

| | | | |
|---|---|---|---|
| 4,438,871 | 3/1984 | Ecker . | |
| 4,949,874 | 8/1990 | Fiedler et al. . | |
| 4,981,241 | 1/1991 | Keller | 222/137 |
| 5,611,463 | 3/1997 | Favre | 222/137 |

FOREIGN PATENT DOCUMENTS

| | | |
|---|---|---|
| 41 20 644 C1 | 3/1993 | Germany . |
| 42 12 413 C2 | 10/1993 | Germany . |

*Primary Examiner*—Philippe Derakshani
*Attorney, Agent, or Firm*—McGlew and Tuttle, P.C.

[57] ABSTRACT

A two-chamber metering dispenser 1 for liquid and/or paste-like media is equipped with two containers 2, 3 made of plastic, which are arranged in parallel positions next to one another and are provided each with a hand-operated metering pump and with a follower piston. The follower piston is tightly in contact over the entire circumference of the inner surface of the containers. In order to optimally utilize the hollow space in the case of an elliptical outer cross-sectional shape, and to guarantee a tight contact between the follower piston and the inner surfaces of the container walls, the two containers 2, 3 form a common outer jacket 10, which has an elliptical cross-sectional shape, and the containers are separated from one another by two middle walls 14, 15, which are arched against each other symmetrically to the short axis 12 of the ellipse.

11 Claims, 5 Drawing Sheets

TWO-CHAMBER METERING DISPENSER

FIELD OF THE INVENTION

The present invention pertains to a two-chamber metering dispenser for liquid and/or paste-like media with two containers made of plastic, which are arranged in parallel positions next to one another and are provided each with a hand-operated metering pump and with a follower piston, which is tightly in contact over the entire circumference of its inner surface.

BACKGROUND OF THE INVENTION

It is important in metering dispensers of this class for the two chambers, in which the media to be dispensed in a metered manner are contained, to have a cross-sectional shape which promotes the tight contact of the follower piston with the entire circumference of the inner surface.

The storage chambers are therefore designed as cylindrical chambers in the prior-art two-chamber metering dispensers of this type (DE 41 20 644 C1, DE 42 12 413 C2, U.S. Pat. No. 4,949,874 and U.S. Pat. No. 4,438,871), and the storage chambers according to DE 42 12 413 and DE 41 20 644 can be inserted in the form of separate containers into a receiving housing, whose head is provided with a two-medium metering pump or with two metering pumps each associated with one container, which can be actuated by a common actuating member.

The other two documents mentioned pertain to two-chamber metering dispensers, in which the cylindrical storage chambers are arranged concentrically one inside the other, wherein the follower piston of the larger storage chamber is sealingly in contact with both the cylindrical inner surface of the circumferential wall and with the cylindrical outer surface of the smaller storage chamber.

The concentric arrangement of the two storage chambers has the drawback that both cannot have the same cross-sectional shape. The side-by-side arrangement of the two cylindrical storage chambers is disadvantageous because there are relatively large unused spaces between the pump housing, which accommodates the two storage containers and preferably has an elongated round shape, and the two cylindrical storage containers, these unused spaces being located between the mutually parallel side walls and the curvatures of the storage containers.

It has also been known that single metering dispensers can be provided with a storage chamber having an at least approximately elliptical cross-sectional shape. Such a cross-sectional shape of the storage chamber is preferred not only because of its optical appearance, but also because it better fits the hand and thus offers advantages in terms of handling. However, two-chamber metering dispensers with an elliptical shape are not known.

If two cylindrical storage chambers were inserted into such an elliptical housing shape, the unused space would be even larger than in the prior-art two-chamber metering dispensers with an elongated round housing shape.

SUMMARY AND OBJECTS OF THE INVENTION

The basic object of the present invention is to provide a two-chamber metering dispenser of the type described in the introduction with an oval, preferably elliptical, outer cross-sectional shape, in which the hollow space defined by the outer shape is optimally utilized by the two containers, on the one hand, and in which the inner surfaces of the container walls guarantee a tight contact of their follower pistons with certainty, on the other hand.

This object is accomplished according to the present invention by the two containers forming a common outer jacket of an at least approximately elliptical shape and by being separated from one another by two middle walls arched against each other symmetrically to the short axis of the ellipse.

A compromise has been found with the solution according to the present invention, which optimally minimizes the unused space, on the one hand, and ensures, due to the arched middle walls, that a tight contact of the follower pistons is guaranteed even in this area of the middle walls.

In a preferred embodiment, a connection web connects the respective middle walls of the containers. The connection web, the respective middle walls and the common outer jacket define two hollow spaces substantially symmetrical to a long axis of the oval cross section. This design contributes to the increase in stability with the thinnest middle walls possible.

The radii of the arched middle walls is substantially equal to a length of a long axis of the oval cross section. Ends of the respective middle wall are connected to the common outer jacket by curvatures having radii less than or equal to 3 mm. This radii of curvature provided compared with the overall size in the cross-sectional shape of the outer wall enclosing the two storage chambers can be considered to be optimal for achieving an all-around tight contact of the two follower pistons with the inner walls of the storage chambers.

The first and second containers include substantially identically shaped individual parts. The first and second containers include snap connection means for connecting the first and second containers to each other. This design makes it possible to prepare the two storage chambers separately and to assemble them into a two-chamber container without gaps in a simple manner. The common outer jacket includes a first wall section bridging over a first half of one of the hollow spaces and a second wall section bridging over a second half of the one hollow space. The snap connection means includes a coupling strip with a tooth connected to the first wall section, and the snap connection means also includes a countertooth connected to the second wall section. The coupling strip and the tooth are formed in one piece with the first wall section, and the countertooth is formed in one piece with the second wall section. The tooth and the countertooth are one of locking and snap-in teeth. This design of the snap connections guarantees a shape of the elements of the snap connection that can be managed in a simple manner in terms of shaping technology, on the one hand, and a good, durable connection between the two individual chambers, on the other hand. In addition, an outer jacket, which forms a practically gapless and continuous overall surface even in the area of the edges abutting each other, is obtained on assembly.

The snap connection means includes a support strip connected to the second wall section and positioned radially inside the common outer jacket and the countertooth. In this way the snap connection can be stabilized and be made nondetachable in conjunction with locking teeth.

The first and second containers have a discharge end, and the first and second metering pumps include a ring wall attachment surrounding the discharge ends of the first and second containers. The discharge end has a cross section shaped substantially equal to the oval cross section of the common outer jacket. A pump snap connection means connects the ring wall attachment of the first and second metering pumps to the discharge ends of the first and second containers. The two storage chambers can be fitted together as individual parts with metering pumps that can be operated separately and are optionally provided with different dispensing openings. It is also possible for the first and second metering pumps to have a common actuating member. The common actuating member includes one of two separate dispensing openings and a common dispensing opening. The two metering pumps can be arranged on a common front wall and can be optionally actuated together.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
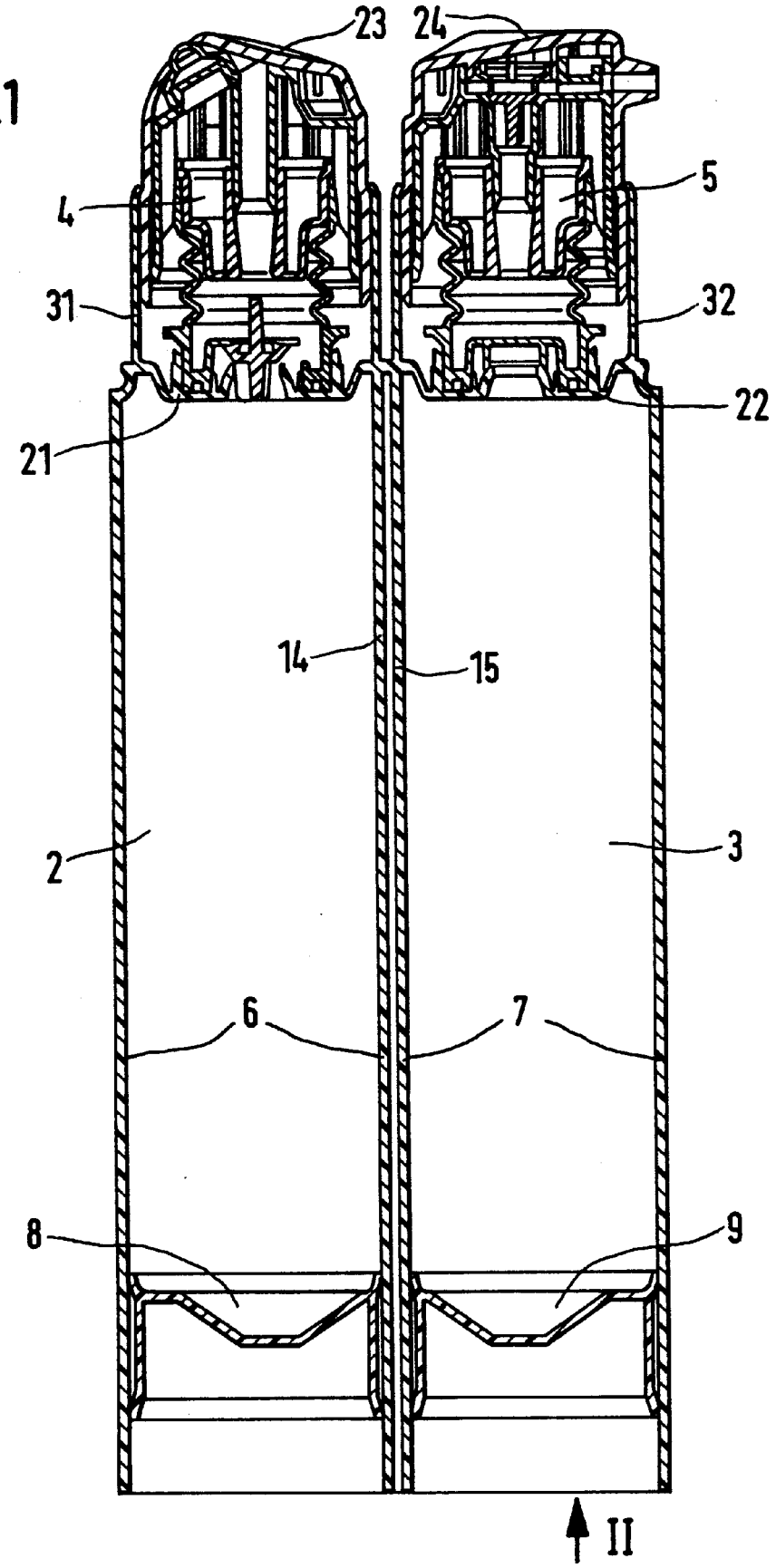
FIG. 1 is a sectional view of a two-chamber metering dispenser.
Figure 2:
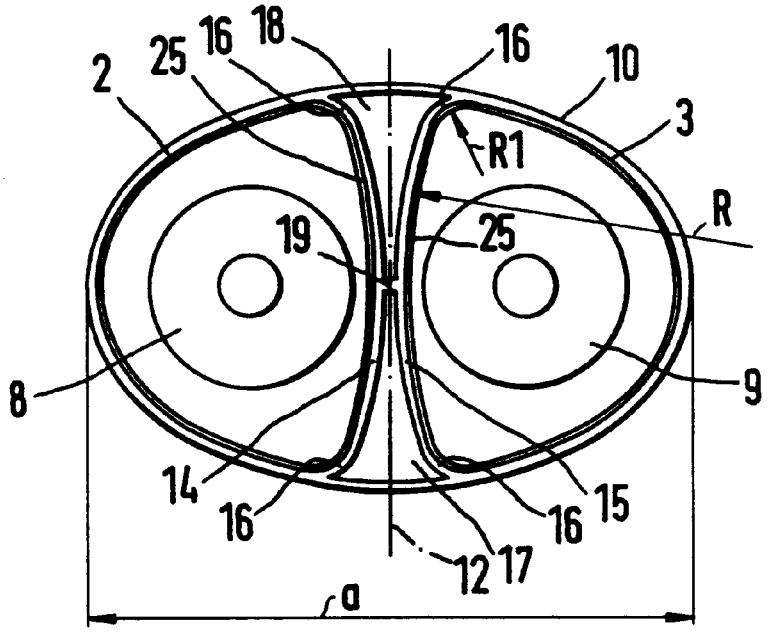
FIG. 2 is a bottom view II from FIG. 1.
Figure 3:
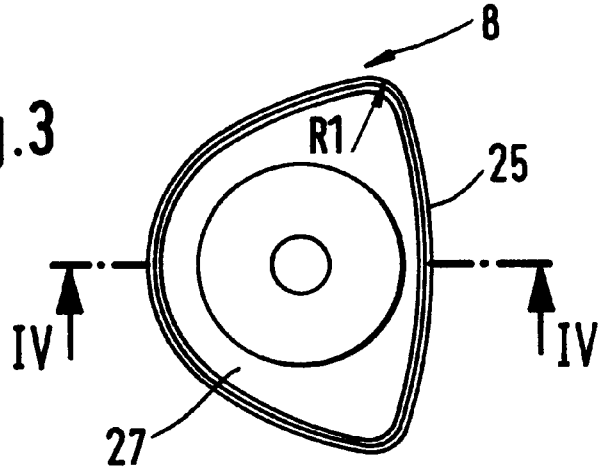
FIG. 3 is a top view the follower piston of a storage chamber.
Figure 4:
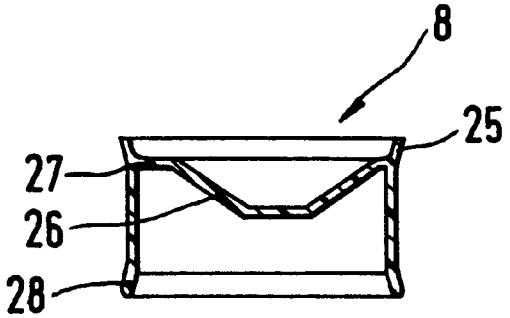
FIG. 4 is a section IV—IV from FIG. 3.

The two-chamber metering dispenser shown in FIGS. 1 and 2 is used to separately dispense two different liquid or paste-like or gel-like media. It comprises two housings or containers 2 and 3 made of plastic, which are arranged next to one another in parallel positions and are each provided with a hand-operated metering pump 4 and 5, respectively. The containers 2, 3 have a respective follower piston 8 and 9, which are tightly in contact with the containers 2, 3 over the entire circumference of their respective inner surface 6 and 7, and which are likewise made of plastic. The two containers 2 and 3 form a common outer jacket 10 of an at least approximately elliptical or oval cross section composed of circular arcs, and they are separated from one another by two middle walls 14 and 15 arched against each other symmetrically to the short axis of the ellipse 12.

To increase stability, the two middle walls 14 and 15 are connected to one another by a middle connection web 19, forming two hollow spaces 17 and 18 symmetrical to the long axis of the ellipse. The radii of curvature R of the middle walls 14 and 15, which are congruent with one another and are arranged mirror-inverted in relation to one another, approximately correspond to the length a of the long axis 13 of the ellipse of the common outer jacket 10. The ends of the middle walls 14 and 15 are connected in one piece to the outer jacket 10 by curvatures 16, whose radii of curvature R1 should not be smaller than 3 mm to ensure that the lip-like sealing edges 25 of the mutually identical follower pistons 8 and 9 are able to be in tight contact even in the area of these curvatures 16.

The two follower pistons 8 and 9 consist, in the known manner, of hollow bodies with a basic shape adapted to the cross-sectional shape of the containers 2 and 3 and with a closed radial wall 26 of a trapezoidal cross section.

The circular sealing lip 25, which is closed in itself, is arranged above a flat annular section 27 of the radial wall 26, while a guide edge 28 of conical cross section is provided at the opposite end of the hollow body.

The two metering pumps 4 and 5 are arranged on the respective upper front walls 21 and 22 of the two containers 2 and 3, and their movable, hood-like actuating members 23 and 24 are guided in ring walls 31 and 32 attached in one piece each.

Figure 5:
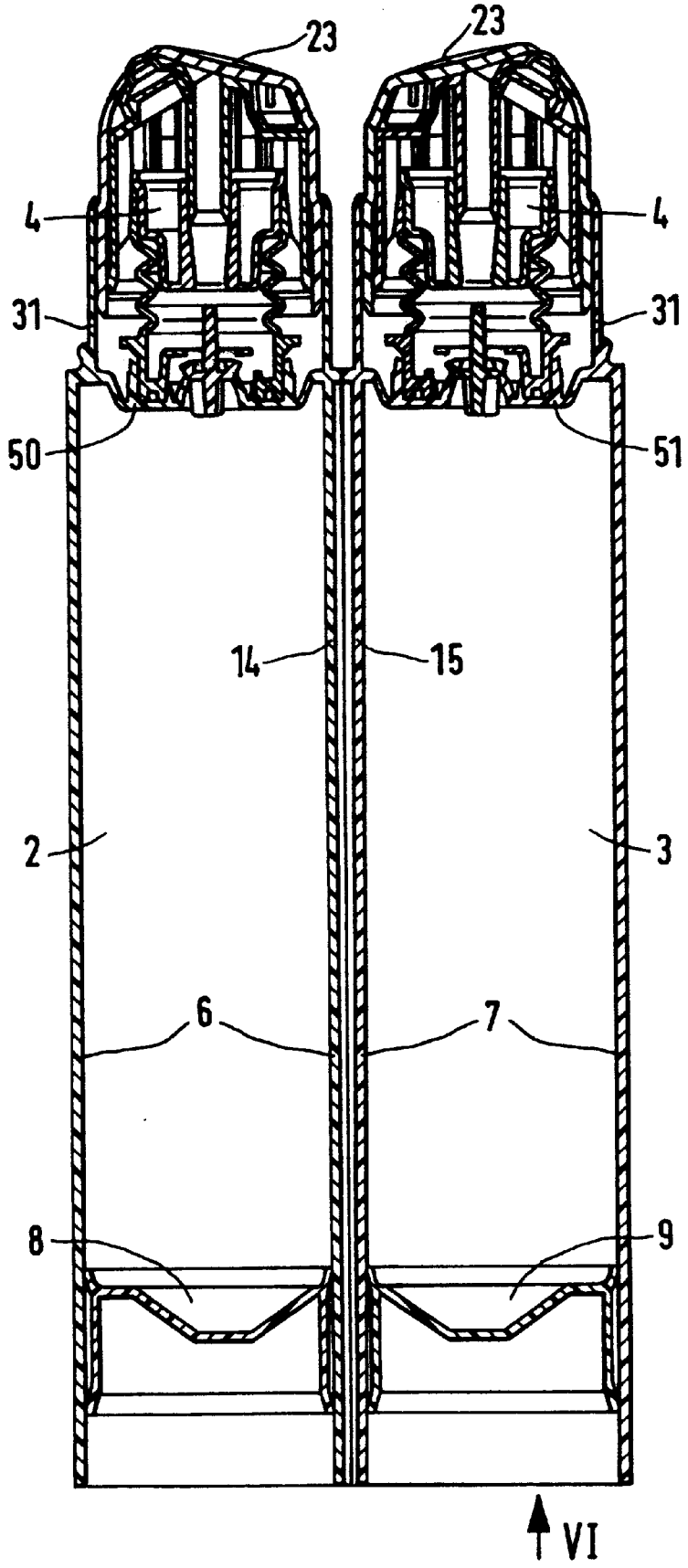
FIG. 5 is a sectional view of a two-chamber metering dispenser assembled from two individual storage chambers.
Figure 6:
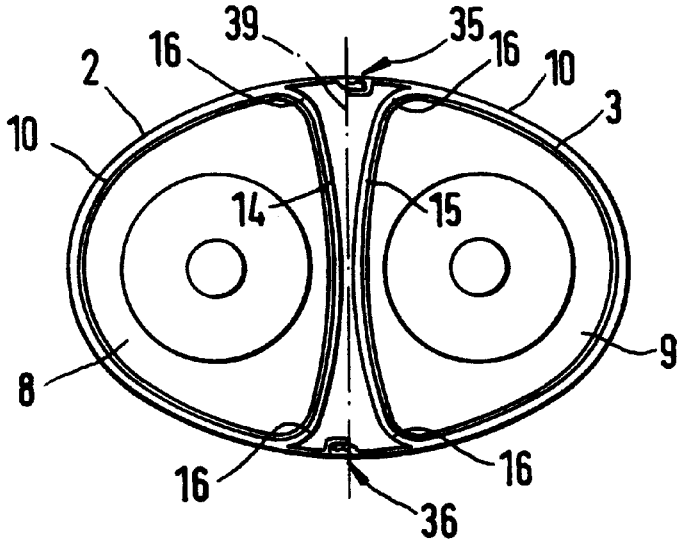
FIG. 6 is a view VI from FIG. 5.

In the embodiment according to FIGS. 5 to 11, inclusive, the two containers 2 and 3 with a respective middle wall 14 and 15 each consist of two separate individual bodies of identical shape, which are assembled without a gap by means of snap connection means 35 and 36. Thus, the two containers 2 and 3 form an outer jacket 10 that is closed in itself in the assembled state, as is shown in FIG. 6, and as is also seen in the exemplary embodiment according to FIGS. 1 and 2.

The two snap connections 35 and 36 are located diametrically opposite each other. As can be seen best in FIG. 7*a*, the two snap connections 35 and 36 of a coupling strip 40 are each made in one piece with the inside of a wall section 41, and close off or bridge over half the respective hollow space 17 and 18 located between the middle walls in the assembled state with the respective other container 2 and 3. The snap connections are provided each with a front surface 42 located in the plane of the common middle axis 39.

The coupling strip 40 projects laterally beyond this common middle axis 39 and is provided on the outside with a radially outwardly projecting snap-in or locking tooth 43. The tooth 43 advantageously extends over the entire length or height of the respective container 2 and 3, and thus appears as a rib, which has the shape of a snap-in or locking tooth.

Furthermore, the snap connections 35 and 36 consist of counter-snap-in or counterlocking teeth 45, which are made in one piece with the inside of a wall section 46, which likewise has a radial front surface 47, which is in gap-free contact with the front surface 42 of the wall section 41 in the assembled state of the two parts. The wall section 46 thus bridges over the other half of the respective hollow space 17 and 18 located between the two middle walls 14 and 15.

Figure 7:
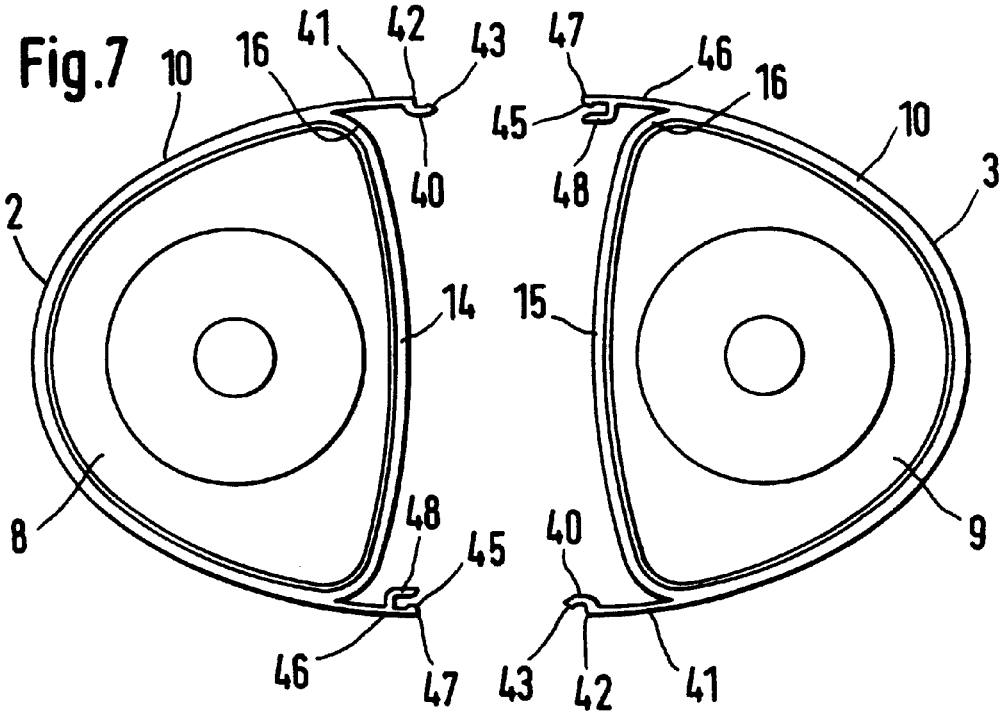
FIG. 7 is a view according to FIG. 6 of two storage chambers as individual parts.
Figure 7A:
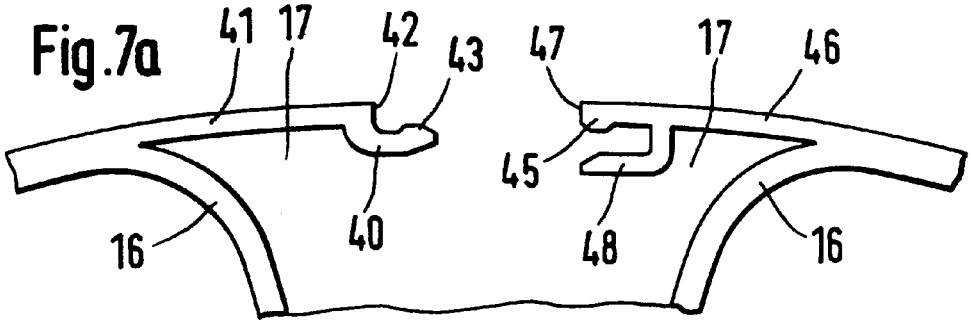
FIG. 7*a* is a greatly enlarged view of the elements of a snap connection.
Figure 8:
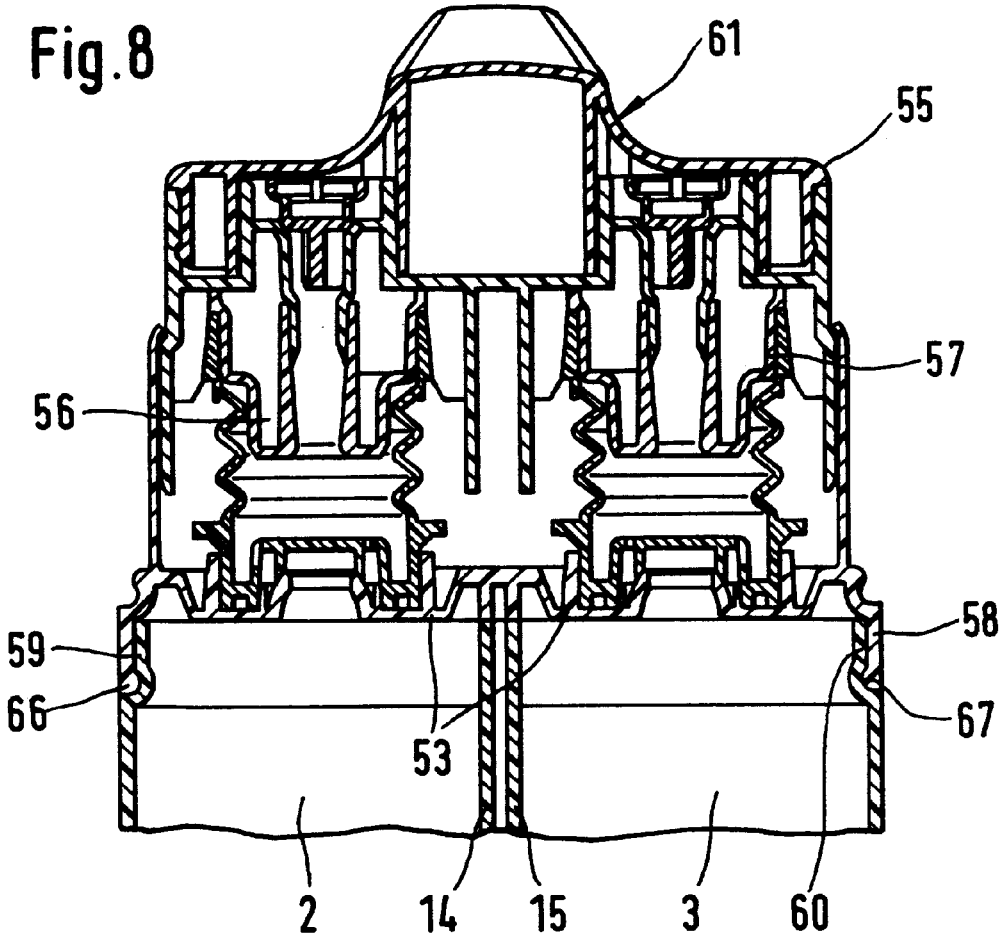
FIG. 8 is a view of a metering pump head with two metering pumps, which can be actuated together and are associated with one storage chamber each.
Figure 9:
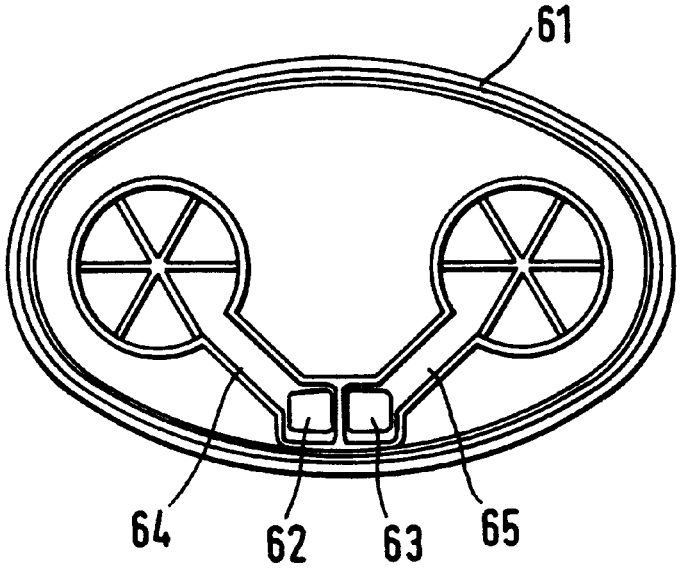
FIG. 9 is a bottom view of the common actuating member of the two metering pumps from FIG. 8.

As is apparent from FIG. 7, the two containers 2 and 3 made as individual parts have a cross-sectional shape that is identical in all details, i.e., they represent the same part, which is present in duplicate. On assembly, the container 3 is simply rotated by 180° in relation to the container 2, so that the snap connection elements made in one piece with the two wall sections 41 and 46 can be assembled in a positive-locking manner.

To secure and stabilize the positive-locking engagement between the snap-in or locking teeth 43, on the one hand, and the counter-snap-in or counterlocking teeth 45, on the other hand, a support strip, on which the coupling strip 40 is radially supported, is made in one piece with the wall section 46. Two very stable snap connections are thus obtained, especially if locking teeth 43 and 45, which form a nondetachable connection, are provided instead of snap-in teeth 43 and 45.

Just like the snap-in or locking tooth 43, the counter-snap-in or counterlocking tooth 45 may also extend over the entire length or height of the respective containers 2 and 3 and thus appear as a snap-in or locking rib in the cross-sectional shape of a snap-in or locking tooth.

Each of the two containers 2 and 3 are provided with upper front walls 50 and 51 in the exemplary embodiment according to FIGS. 5 and 6, just as in the exemplary embodiment according to FIGS. 1 and 2. On these front walls 50, 51 two identical metering pumps 4 are seated. A pump head 55 with two identical metering pumps 56 and 57 may be attached, according to FIGS. 8 through 11, on two assembled containers 2 and 3, which do not have upper front walls in this case. Instead of the front walls 50 and 51, the two containers 2 and 3 are provided at their upper ends with respective wall sections 59 and 60, which are offset to the inside by the wall thickness and are tightly surrounded by a ring wall 58, which has the same cross-sectional shape as the common outer jacket 10.

This ring wall 58 is part of a common front wall 53, on which the two metering pumps 56 and 57 are arranged. To actuate the two metering pumps 56 and 57 of the pump head 55, a hood-like actuating member 61 is provided, which has two dispensing openings 62 and 63 arranged adjacent to one another. These dispensing openings 62 and 63 are in connection with the metering pumps 56 and 57 through delivery channels 64 and 65, so that the media contained in the two containers 2 and 3 can be dispensed simultaneously in a metered manner from the two containers 2 and 3 during each pump stroke of the actuating member 61.

To make it possible to connect the ring wall attachment 58 to the inwardly offset wall sections 59 and 60 of the two containers 2 and 3 in a simple manner, securingly and at the same time sealingly, it is advantageous to also provide pump snap connection elements or means in the form of, e.g., respective annular ribs 67 and 66, which engage corresponding annular grooves of the wall sections 59 and 60 or vice versa.

The features described in specification, drawings, abstract, and claims, can be used individually and in arbitrary combinations for practicing the present invention.

While specific embodiments of the invention have been shown and described in detail to illustrate the application of the principles of the invention, it will be understood that the invention may be embodied otherwise without departing from such principles.

What is claimed is:

1. A metering dispenser comprising:

first and second containers arranged adjacent each other and forming a common outer jacket with an oval cross section, said first and second containers including respective middle walls arched against each other, said respective middle walls being substantially symmetrical with a short axis of said oval cross section;

first and second metering pumps connected to respective said first and second containers;

first and second follower pistons arranged in respective said first and second containers, said first and second follower pistons being in contact with an inner circumference of said respective first and second containers.

2. A dispenser in accordance with claim 1, wherein:

a connection web connects said respective middle walls of said containers, said connection web, said respective middle walls and said common outer jacket define two hollow spaces substantially symmetrical to a long axis of said oval cross section.

3. A dispenser in accordance with claim 1, wherein:

a radii of said arched middle walls is substantially equal to a length of a long axis of said oval cross section;

ends of said respective middle wall are connected to said common outer jacket by curvatures having radii less than or equal to 3 mm.

4. A dispenser in accordance with claim 1, wherein:

said first and second containers include substantially identically shaped individual parts, said first and second containers include snap connection means for connecting said first and second containers to each other.

5. A dispenser in accordance with claim 4, wherein:

said respective middle walls and said common outer jacket define two hollow spaces substantially symmetrical to a long axis of said oval cross section;

said common outer jacket includes a first wall section bridging over a first half of one of said hollow spaces and a second wall section bridging over a second half of said one hollow space;

said snap connection means includes a coupling strip with a tooth connected to said first wall section, and said snap connection means includes a countertooth connected to said second wall section.

6. A dispenser in accordance with claim 5, wherein:

said coupling strip and said tooth are formed in one piece with said first wall section;

said countertooth is formed in one piece with said second wall section;

said tooth and said countertooth are one of locking and snap-in teeth.

7. A dispenser in accordance with claim 5, wherein:

said snap connection means includes a support strip connected to said second wall section and positioned radially inside said common outer jacket and said countertooth.

8. A dispenser in accordance with claim 4, wherein:

said first and second containers have a discharge end;

said first and second metering pumps include a ring wall attachment surrounding said discharge ends of said first and second containers, said discharge end having a cross section shaped substantially equal to said oval cross section of said common outer jacket.

9. A dispenser in accordance with claim 8, wherein:

a pump snap connection means connects said ring wall attachment of said first and second metering pumps to said discharge ends of said first and second containers.

10. A dispenser in accordance with claim 5, wherein:

said first and second metering pumps include a common actuating member, said common actuating member includes one of two separate dispensing openings and a common dispensing opening.

11. A dispenser in accordance with claim 1, wherein:

said first and second metering pumps include means for hand pumping one of liquid and paste-like media;

said first and second containers are formed of plastic are positioned substantially in parallel;

said first and second follower pistons are in tight contact with an entire said inner circumference of said respective first and second containers;

said oval cross section is substantially elliptical.

* * * * *